United States Patent [19]

Teh-Sheng

[11] 4,062,635

[45] Dec. 13, 1977

[54] AUTOMATIC TOOTH-PASTE-SUPPLYING TOOTH BRUSH

[76] Inventor: Wu Teh-Sheng, No. 126 Chung Kung Road, Hsias Kang Shien (812), China /Taiwan

[21] Appl. No.: 654,649

[22] Filed: Feb. 2, 1976

[51] Int. Cl.[2] ..... B43K 5/06

[52] U.S. Cl. ..... 401/175; 401/287

[58] Field of Search ..... 401/175, 286, 287

[56] References Cited

U.S. PATENT DOCUMENTS

| | | | |
|---|---|---|---|
| 1,486,394 | 3/1924 | Smith | 401/175 X |
| 2,997,078 | 8/1961 | Gainer | 401/175 X |
| 3,868,188 | 2/1975 | Velardi | 401/175 X |
| 3,891,127 | 6/1975 | Fernandez et al. | 401/175 |

FOREIGN PATENT DOCUMENTS

| | | | |
|---|---|---|---|
| 643,983 | 8/1962 | Italy | 401/175 |

*Primary Examiner*—Stephen C. Pellegrino

*Attorney, Agent, or Firm*—Laurence R. Brown

[57] ABSTRACT

The invention disclosed relates to a toothbrush which comprises in combination, bristles, guide tube means and a source container from which a viscous substance is forced through apertures disposed near the bristles to the surface thereof. The flow of the viscous substance to the bristles is manually controlled by means of a knob disposed on the outside surface of a main shaft. An extension end of the container is provided to contain the toothbrush bristles and may be configurated as a toothbrush head. An opposite end of the toothbrush head includes a knob which is disposed for advancing a follower member which serves to force the viscous substance to the opening of the aperture which permits the viscous substance to surface to the bristles. At the forward end of the main shaft which contains the follower member, there is disposed a plug which permits closure of the open aperture thereby avoiding danger of leakage of the viscous substance during non-usage periods.

5 Claims, 8 Drawing Figures

AUTOMATIC TOOTH-PASTE-SUPPLYING TOOTH BRUSH

The present invention relates to a fountain toothbrush having means to force a viscous substance through an aperture disposed near the bristles when a plug is removed from disposed position over the aperture.

In operation, when it is desired to use the toothbrush, the knob is turned to push the plug forward with the main shaft and thereby open the aperture disposed in a channel under the bristles. Next, the follower acts to force the viscous substance through a passage and guide tubes to the aperture and to the surface of the bristles. Return of the knob in the opposite direction recedes the follower and the main shaft and reduces the pressure in the container of the viscous substance while closing the aperture by means of the plug thereby preventing the viscous substance from leaking out the aperture during non-usage periods.

The embodiments of the present invention are economical to manufacture and require a minimum of associated parts while eliminating the inconvenience of dispensing toothpaste directly onto the bristles of a toothbrush from a conventional toothbrush paste tube.

Generally stated, the present invention relates to a toothbrush in which a paste or viscous substance is dispensed directly onto the bristles from a supply container joined to the brush head and handle, the flow of paste to the surface of the bristles being manually controlled by the knob located at the exterior of the container. Although this invention is particularly useful as a toothbrush, it will be recognized that it can be used for other purposes as desired.

While it is known in the prior art to provide toothbrushes with a toothpaste container disposed in a handle portion for dispensing dentifrices to the surface of the brush bristles, such prior art devices have been constructed such that they have not been satisfactory because of complex manufacturing difficulties, they have leaked during periods of non-use, and have wasted dentifrice.

SUMMARY OF THE INVENTION

In accordance with the present invention, a first embodiment of which includes a dispensing toothbrush provided with an aperture and closure plug, a follower disposed for movement by means of a knob located exterior of the paste container joining the brush which forces controlled amounts of toothpaste or dentifrice from the supply container through a passage to a guide tube and to the surface of the bristles. In use, the toothbrush is activated by rotation of the knob which dispenses a desired amount of toothpaste to the bristles after the main shaft including the plug and follower is advanced a certain distance by means of the rotating knob. Thus, in this invention, dispensing of the paste is accomplished quite easily.

In an embodiment of the toothbrush, the supply container is joined as part of the handle to the brush head. The handle has an end which can be threaded to facilitate rotation relative the toothbrush head while being sealed to contain leakage of the paste.

These embodiments are economical to manufacture, they require a minimum number of parts, and eliminate the conventional toothpaste tube as a separate element.

In addition, the present toothbrush eliminates waste of toothpaste due to leakage from the aperture under the bristles since the present aperture is opened or closed by means of a plug which is moved along the main shaft during supply of the paste.

An object of the present invention provides a toothbrush head and handle disposed relative a main rotating shaft which can be discarded after being used or broken because the toothbrush is economically produced.

Numerous other objects, advantages and features of the present invention will become apparent with reference to the drawings, wherein.

DESCRIPTION OF THE PREFERRED EMBODIMENTS

Figure 1:
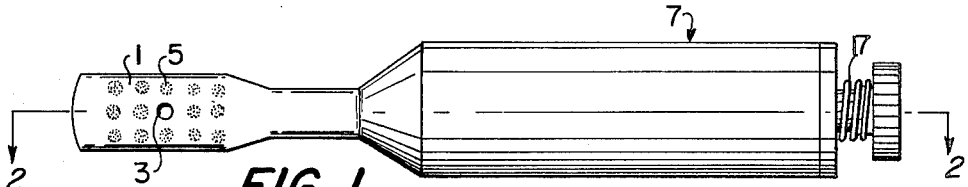
FIG. 1 is a bottom view of a first embodiment of the present invention illustrating the fountain toothbrush.

FIGS. 1-6 show a first embodiment of a dispensing toothbrush according to the present invention having a self-contained supply container along with the bristles 5 and guide tubes 3.

Brush head 1 which is configurated as a portion of the supply container is conventionally characterized except one or more guide tubes 3 are positioned along the base of the bristles. The upper part of the guide tubes provide a passage made of nylon or thin soft tubing severed along the sides to function also as fine bristles. The bottom portion of the guide tubes are confined and planted over the aperture 2. The rear end of tubular handle 7 is threaded along the interior which matches the exterior threaded portion of the rear gate 11 which can be fixed into handle 7. The very center of rear gate 11 is made into an interior threaded nut which matches the screw rod 19 from section C to D of the main shaft 8. The rear gate 11 supports the main shaft 8 and helps it to move forward or rearward while rotating freely.

Figure 4:
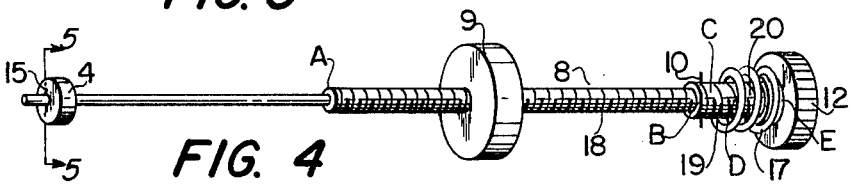
FIG. 4 is an elevational view illustrating the main shaft and related elements of the present invention.

An important part of the supply container is main shaft 8 shown in FIG. 4. The main shaft 8 is provided with plug 4 which provides a means to open and close aperture 2. A left or right handed threaded bolt 18 is used to move follower 9. Follower 9 is used to force the dentifrice while stopper 10 prevents withdrawing beyond a fixed location. Plug 4 is then restricted to closing position. A right or left externally threaded bolt 19 which is used to move the main shaft 8 forward or rearward. A section of the rod 20 from points D to E is used to rotate the main shaft 8 freely during rotation in threaded nut of rear gate 11. Reacting spring 17 is used to connect externally threaded bolt 19 and interior threaded nut of rear gate 11 easily. A knob is provided to rotate the main shaft 8.

Figure 2:
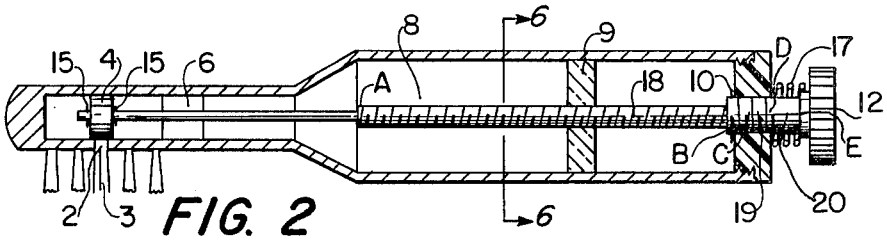
FIG. 2 is a view taken along line 2—2 of FIG. 1 and illustrating the aperture of the present device in closed position.

The cross sectional dimension of the plug 4 positioned by two pins 15 is as large as the passage 6 such to prevent the dentifrice from leaking out of the container while it moves backward in closed position as shown in FIG. 2. The exterior diameter of the follower 9 is about the same as the interior diameter of the handle 7 of the container and its center is made into the interior threaded nut which fits the screw rod 18. The follower is frictionally engaged within handle 7 such to be held against rotation and is slidable by means of threaded screw rod 18(AB) and 19(CD), the threaded rod 18(AB) of which engages the follower 9. Screw rod 18(AB) is made such that follower 9 is slid, either into left or right threaded direction and screw rod 19(CD) which fits the interior threaded nut of the rear plate 11 also in either the right or left threaded direction. Round rod 20 has a diameter behind screw rod 19(CD) into slightly smaller than interior diameter of the rear gate 11, and its length must be slightly longer than the interior of threaded nut of the rear gate 11. Thus, the main shaft 8 can be rolled freely after screw rod 19(CD) moves through the interior of the threaded nut of rear gate 11. By turning the knob 12, the main shaft 8 will not move forward but instead the follower 9 will be moved. The reacting spring 17 disposed near knob 12 provides the reacting force which provides for connection between screw rod 19(CD) and interior threaded nut of rear gate 11 more easily while the knob 12 is turned in the opposite direction. Knob 12 is rotated such to rotate the main shaft 8.

Suppose that screw rod 18(AB) is threaded with left directional threads and put onto screw rod 19(CD) with right direction threads, then the plug 4 may be at its closed position as shown in FIG. 2.

Figure 3:
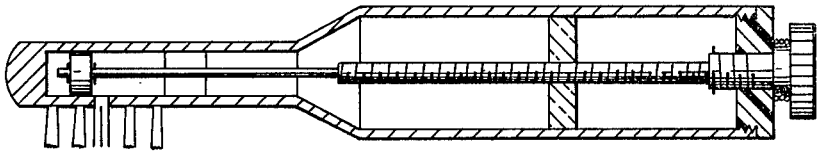
FIG. 3 is a view taken along line 2—2 of FIG. 1 and illustrating the aperture of the present device in open position.

By turning knob 12 in a clockwise direction, the screw rod 19(CD) moves forward such that plug 4 is moved forward to open the aperture 2 and the main shaft 8 carries the follower 9 which forces the dentifrice paste forward. Main shaft 8 stops at the round rod 20(DE) in the interior threaded nut of rear gate 11 and rolls freely. The more knob 12 is rotated the more dentifrice paste comes up to the surface of the bristles, as shown in FIG. 3. By means of reating force of spring 17, the connection between screw rod 19(CD) and interior threaded nut of rear gate 11 will be easily attained. By rotation of knob 12 in a counterclockwise direction recedes the movement on main shaft 8 to close aperture 2 to prevent paste from leaking and to pull follower 9 rearwardly. By turning the knob 12 continuously, the main shaft will move back and stop at stopper 10 as shown in FIG. 2. By having a right threaded screw rod 18(AB) and a left threaded screw rod 19(CD), it is possible to have a counteraction movement and yet achieve the same effect.

Figure 7:
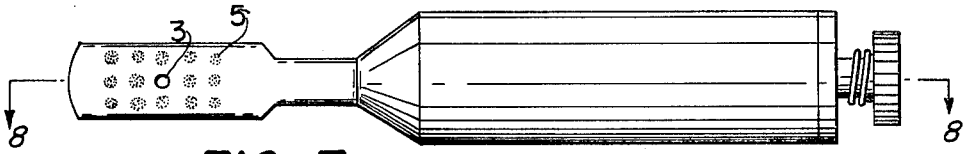
FIG. 7 is a bottom view of a second embodiment of the present invention.
Figure 8:
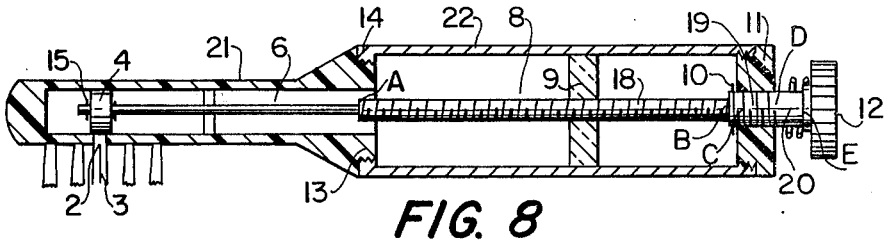
FIG. 8 is a view taken along sectional lines 8—8 of FIG. 7 illustrating a removable connection for the brush head and handle containing the toothpaste.
Figure 5:
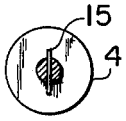
FIG. 5 is a front elevational view taken along lines 5—5 of FIG. 4 illustrating the plug element enlarged.
Figure 6:
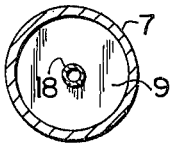
FIG. 6 is a view taken along lines 6—6 of FIG. 2.

FIGS. 7–8 show a second embodiment of the dispensing toothbrush of this invention. Dispensing toothbrush of the embodiment device has a brush head 21 identical to the brush head previously described. Instead, the toothbrush 21 is externally threaded onto the neck of the handle 22 by engagement of threads at the outside of the tip 13 of toothbrush head 21 with the threads on the interior of tubular base 14 of handle 22. The brush handle 21 of the handle 22 or the main shaft 8 can be discarded after either being broken or worn.

In view of the foregoing explanation, it is apparent that application of the present invention provides several unique advances in toothbrush construction, each of which includes bristles, guide tubes and paste supply container which cooperate as a brush head and handle and from which dentifrice or toothpaste is dispensed in a controlled manner directly to the surface of the bristles.

The brush head of the present invention looks exactly like an ordinary brush except having one or more guide tubes planted along the bristles by which toothpaste is injected to the surface. The guide tubes may be made of nylon or soft thin tubes, and cut along an upper part into fine threads. The guide tubes are then planted into apertures provided as desired.

The injector has a main function to contain the toothpaste, the grip or handle for the brush and the injector mechanism which pushes the toothpaste to the surface of the bristles.

The front end of the main shaft is configurated as a fine rod and the rear end is a screw head. The rod diameter between (D) to (E) must be smaller than the inner diameter of the rear gate 11. Also the length of (D) to (E) must be a little longer than the length of the female thread of the rear gate. Thus, the main shaft can turn freely in the rear gate after getting through the female thread of the rear gate. By continuing to turn the knob, the main shaft will not move forward, but the follower will only push the paste forward. The function of the knob at the end of the device is to turn the main shaft.

The present device may be formed such that the handle disconnects from the brush head. Advantages of this configuration is that the container can be changed, separately, the device is easy to carry, and may be easily cleaned.

While the preferred embodiments of the present invention have been described for use as a toothbrush, it is to be understood that these embodiments can be used for other purposes, such a shoe polish, paint, and cleaning or coating compounds for various materials, and that the shape of the brush can be changed to suit the use of the device, and that numerous other changes can be made in the construction of these brushes without departing from the scope of the invention as specified herein and as set forth in the appended claims.

What is claimed is:

1. A device which comprises in combination, a brush-head disposed onto a handle portion, said handle portion having a container for dispensing a viscous material through a passage therebetween, said brush-head having bristles projecting therefrom, an aperture disposed in the brush-head relative the bristles and in communication with said passage, a partially threaded shaft disposed in the container and passage, said shaft having a plug movably disposed to open and close said aperture, said aperture being disposed perpendicular to the direction of travel of the plug, the aperture being disposed through the wall of the brush-head containing the bristles, said plug being disposed for limited open and close movement in the area of the aperture and within a channel positioned into the brush-head, a follower movable on said partially threaded shaft for forcing the viscous material from the container and to said passage, a knob externally disposed on the container, and means interconnecting said knob and said shaft whereby upon rotation of said knob, said plug and said follower are moved.

2. The device of claim 1 wherein the threaded direction of the follower is opposite to a screw thread direction on said interconnecting means between the knob and the shaft, said interconnecting means comprising a round rod having an external diameter slightly smaller than the interior diameter of an interior threaded nut at the rear gate of the container, and having a length slightly longer than the length of the interior threaded nut of the said rear gate.

3. The device of claim 1 wherein said interconnecting means further includes a reacting spring disposed adjacent the knob for abuttment against a rear gate of the container.

4. The device of claim 1 wherein a plastic tube is planted among the bristles and to the aperture.

5. The device of claim 1 wherein the container is detachable from the brush-head.

* * * * *